US011410811B2

(12) United States Patent
Takeda

(10) Patent No.: US 11,410,811 B2
(45) Date of Patent: Aug. 9, 2022

(54) MULTILAYER COIL COMPONENT

(71) Applicant: Murata Manufacturing Co., Ltd., Kyoto-fu (JP)

(72) Inventor: Yasushi Takeda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 311 days.

(21) Appl. No.: 16/883,928

(22) Filed: May 26, 2020

(65) Prior Publication Data

US 2020/0381160 A1 Dec. 3, 2020

(30) Foreign Application Priority Data

Jun. 3, 2019 (JP) ..... JP2019-103856

(51) Int. Cl.
*H01F 27/28* (2006.01)
*H01F 17/00* (2006.01)

(52) U.S. Cl.
CPC ..... *H01F 17/0013* (2013.01); *H01F 27/28* (2013.01)

(58) Field of Classification Search
CPC .. H01F 17/0013; H01F 27/28; H01F 27/2804; H01F 2017/002; H01F 2017/0026; H01F 2027/2809; H01F 17/048
See application file for complete search history.

(56) References Cited

U.S. PATENT DOCUMENTS 10,892,079 B2 * 1/2021 Takeda ..... H01F 17/0013
11,289,266 B2 * 3/2022 Imada ..... H01F 17/0013
2021/0065975 A1 * 3/2021 Ishima ..... H01F 27/292

FOREIGN PATENT DOCUMENTS

JP 2017-028143 A 2/2017

* cited by examiner

*Primary Examiner* — Adolf D Berhane
(74) *Attorney, Agent, or Firm* — Studebaker & Brackett PC

(57) ABSTRACT

A multilayer coil component includes an element body, and a coil that is provided inside the element body and includes a plurality of coil conductors that are stacked in a stacking direction and are electrically connected to each other. The coil includes a first coil conductor that consists of at least three side portions, a second coil conductor that consists of one or two side portions, a third coil conductor that consists of at least three side portions, and a fourth coil conductor that consists of at least three side portions. The first coil conductor and the second coil conductor contact each other and the third coil conductor and the fourth coil conductor contact each other. The thickness of the first coil conductor is larger than the thicknesses of the third coil conductor and the fourth coil conductor.

20 Claims, 11 Drawing Sheets

MULTILAYER COIL COMPONENT

CROSS-REFERENCE TO RELATED APPLICATION

This application claims benefit of priority to Japanese Patent Application No. 2019-103856, filed Jun. 3, 2019, the entire content of which is incorporated herein by reference.

BACKGROUND

Technical Field

The present disclosure relates to a multilayer coil component.

Background Art

Japanese Unexamined Patent Application Publication No. 2017-28143 discloses a multilayer coil component of the related art. The multilayer coil component includes an element body and a coil that is provided inside the element body. The coil has a plurality of coil portions and a plurality of connection portions, and the coil portions and the connection portions are stacked in a stacking direction and connected to one another. In other words, the plurality of coil portions and the plurality of connection portions constitute coil-forming layers that form the coil.

In the multilayer coil component of the related art, when the number of turns of the coil is two, four coil portion layers and two connection portion layers, that is, a total of six coil-forming layers are required. When the number of coil-forming layers is large as in this case, the height of the multilayer coil component in the stacking direction is large and it is difficult to realize a low profile for the multilayer coil component. However, although it may be conceivable to reduce the number of coil-forming layers in order to reduce the profile of the multilayer coil component, for example, when the number of coil portion layers is reduced, there is a risk of the direct-current resistance value (Rdc) of the multilayer coil component becoming large.

SUMMARY

Accordingly, the present disclosure provides a multilayer coil component that can reduce the direct-current resistance value and realize a low profile.

A multilayer coil component according to a preferred embodiment of the present disclosure includes an element body; and a coil that is provided inside the element body and includes a plurality of coil conductors that are stacked in a stacking direction and are electrically connected to each other.

The coil includes a first coil conductor that consists of at least three side portions, a second coil conductor that consists of one or two side portions, a third coil conductor that consists of at least three side portions, and a fourth coil conductor that consists of at least three side portions.

The first coil conductor and the second coil conductor contact each other and the third coil conductor and the fourth coil conductor contact each other.

A thickness of the first coil conductor is larger than thicknesses of the third coil conductor and the fourth coil conductor.

According to this configuration, the thickness of the first coil conductor is larger than the thicknesses of the third coil conductor and the fourth coil conductor. Therefore, when the lengths of the coil conductors in the direction in which they extend are referred to as the coil lengths of the coil conductors, the first coil conductor, which has a long coil length, contacts the second coil conductor, which has a short coil length, and therefore the area of contact between the first coil conductor and the second coil conductor is small, but the direct-current resistance value can be decreased by increasing the cross-sectional area of the first coil conductor by making the thickness of the first coil conductor large.

On the other hand, the third coil conductor, which has a long coil length, contacts the fourth coil conductor, which has a long coil length, and therefore the area of contact between the third coil conductor and the fourth coil conductor is large and an increase in the direct-current resistance value can be reduced even though the thicknesses of the third coil conductor and the fourth coil conductor are small. Furthermore, as a result of the thicknesses of the third coil conductor and the fourth coil conductor being small, the height of the multilayer coil component in the stacking direction can be reduced and a low profile can be achieved for the multilayer coil component.

Therefore, the direct-current resistance value can be made small and a low profile can be achieved for the multilayer coil component.

Furthermore, in the multilayer coil component according to the preferred embodiment, the third coil conductor and the fourth coil conductor may contact each other at at least two side portions.

With this configuration, since the third coil conductor and the fourth coil conductor contact each other at at least two side portions, the area of contact between the third coil conductor and the fourth coil conductor is large, and therefore an increase in the direct-current resistance value can be reduced even through the third coil conductor and the fourth coil conductor have small thicknesses.

Furthermore, in the multilayer coil component according to the preferred embodiment, the first coil conductor and the second coil conductor may contact each other at one side portion.

According to this configuration, since the first coil conductor and the second coil conductor contact each other at one side portion, the area of contact between the first coil conductor and the second coil conductor is small, but the direct-current resistance value can be reduced by making the thickness of the first coil conductor large.

In addition, in the multilayer coil component according to the preferred embodiment, the coil may include a fifth coil conductor that consists of one or two side portions. Also, the first coil conductor, the second coil conductor, the third coil conductor, the fourth coil conductor, and the fifth coil conductor may be sequentially stacked in the stacking direction, may be electrically connected in series with each other, and may form two turns.

With this configuration, the first coil conductor, the second coil conductor, the third coil conductor, the fourth coil conductor, and the fifth embodiment are sequentially stacked in the stacking direction, are electrically connected in series with each other, and form two turns, and therefore the number of coil conductor layers that are stacked in two turns of the coil can be made to be five and the number of stacked coil conductor layers can be reduced. Therefore, the height of in the stacking direction can be further reduced and a lower profile can be realized for the multilayer coil component.

In addition, in the multilayer coil component according to the preferred embodiment, the plurality of coil conductors may each include a contact portion that is a part of the coil conductor that contacts another coil conductor adjacent thereto in the stacking direction and a non-contact portion that is a part of the coil conductor that does not contact another coil conductor that is adjacent thereto in the stacking direction. Also, in at least one coil conductor among the plurality of coil conductors, a width of the non-contact portion may be larger than a width of the contact portion.

According to this configuration, the cross-sectional area of the non-contact portion can be increased and the direct-current resistance value can be reduced by increasing the width of the non-contact portion.

In the multilayer coil component according to the preferred embodiment, the coil may have a substantially quadrangular shape when viewed in the stacking direction, and the respective non-contact portions of the plurality of coil conductors may be located at one side of the coil when viewed in the stacking direction.

According to this configuration, large-width non-contact portions can be arranged so as to be concentrated at one side of the coil and the inductance (L) can be further improved without reducing the area of the inner-diameter part of the coil.

In the multilayer coil component according to the preferred embodiment, the coil may have a substantially rectangular shape when viewed in the stacking direction, and the respective non-contact portions of the plurality of coil conductors may be located at a short side of the coil when viewed in the stacking direction.

According to this configuration, the inner-diameter part of the coil is substantially square shaped or close to a square shape, and therefore the inductance can be further improved.

In addition, in the multilayer coil component according to the preferred embodiment, the plurality of coil conductors may each include a contact portion that is a part of the coil conductor that contacts another coil conductor that is adjacent thereto in the stacking direction and a non-contact portion that is a part of the coil conductor that does not contact another coil conductor that is adjacent thereto in the stacking direction. Also, the respective contact portions of the coil conductors that are adjacent to each other in the stacking direction may contact each other and be connected to each other, and contact regions where the contact portions contact each other may be all located at different positions when viewed in the stacking direction, the number of turns of the coil may be two, and the number of stacked coil conductor layers may be five.

According to this configuration, since all of the contact regions are located at different positions when viewed in the stacking direction, a situation in which the thick parts of the coil are concentrated in a single place can be avoided and stress can be relaxed. Furthermore, since the number of turns of the coil is two and the number of stacked coil conductor layers is five, the height of the multilayer coil component in the stacking direction can be reduced and a low profile can be realized for the multilayer coil component.

According to the multilayer coil component of the preferred embodiment of the present disclosure, the direct-current resistance value can be reduced and a low profile can be achieved.

Other features, elements, characteristics and advantages of the present disclosure will become more apparent from the following detailed description of preferred embodiments of the present disclosure with reference to the attached drawings.

DETAILED DESCRIPTION

Hereafter, multilayer coil components according to aspects of the present disclosure will be described in detail by referring to illustrated embodiments. The drawings include schematic drawings and may not reflect the actual dimensions and proportions.

First Embodiment

Figure 1A:
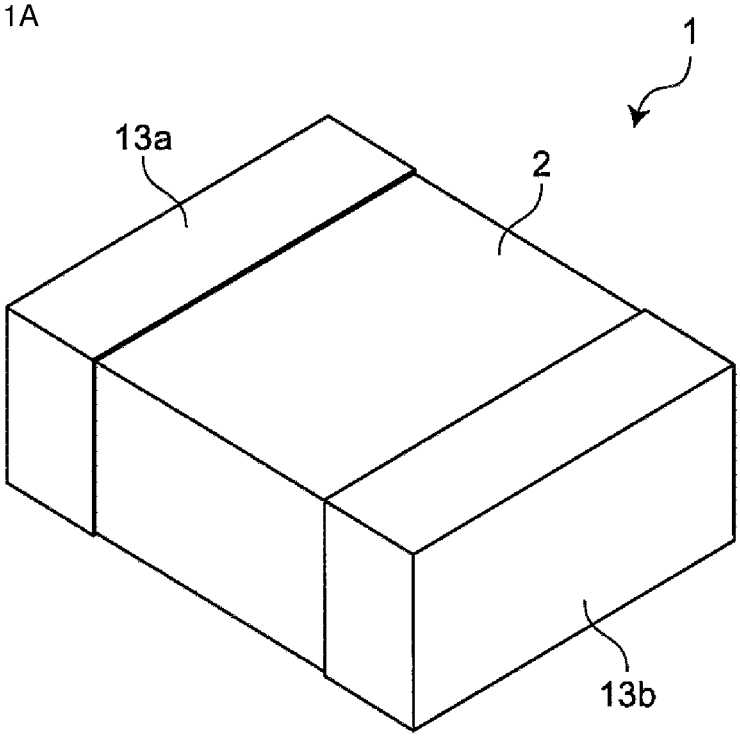
FIG. 1A is a schematic perspective view illustrating the exterior of a multilayer coil component of a first embodiment.
Figure 1B:
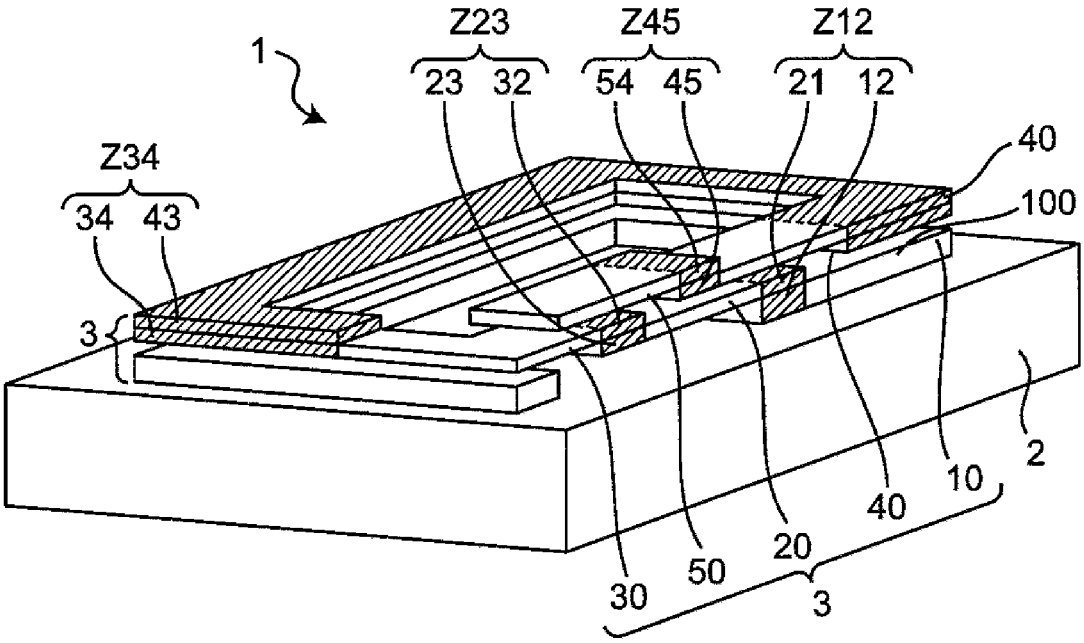
FIG. 1B is a partial schematic perspective view of the multilayer coil component.
Figure 2:
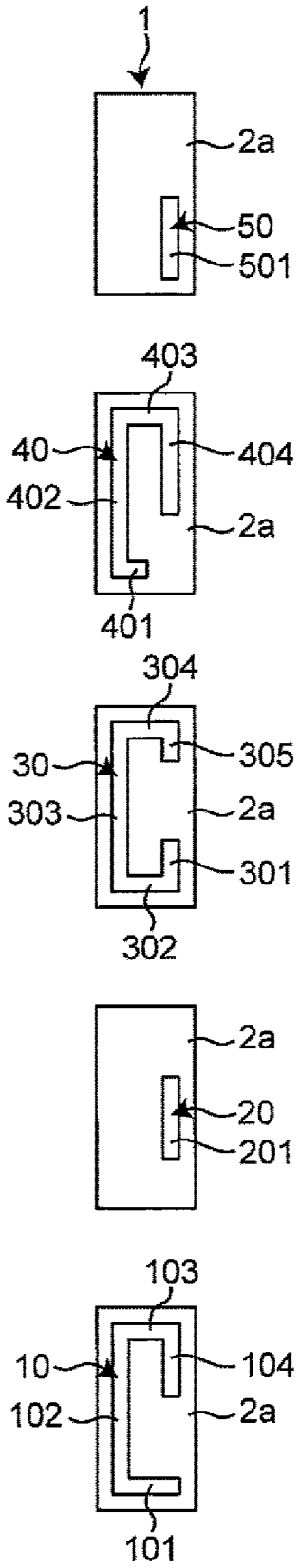
FIG. 2 is an exploded plan view of the multilayer coil component.

FIG. 1A is a schematic perspective view illustrating the exterior of a multilayer coil component of a first embodiment. FIG. 1B is a partial schematic perspective view of the multilayer coil component. FIG. 2 is an exploded plan view of the multilayer coil component. As illustrated in FIGS. 1A, 1B, and 2, a multilayer coil component 1 includes an element body 2, a coil 3 that is provided inside the element body 2, and a first outer electrode 13*a* and a second outer electrode 13*b* that are provided on the outside of the element body 2. In FIG. 1B, for ease of understanding, only the part of the element body 2 that is located below the coil 3 is illustrated.

The multilayer coil component 1 is electrically connected to wiring lines on a circuit board, which is not illustrated, via the first outer electrode 13*a* and the second outer electrode 13*b*. The multilayer coil component 1 is for example used as a noise-removing filter, and for example is used in an electronic appliance such as a personal computer, a DVD player, a digital camera, a TV, a cellular phone, or an in-car electronic appliance.

The element body 2 is formed of a plurality of insulating layers 2*a*. The insulating layers 2*a* are ceramic layers for example, and the ceramic layers are composed of a magnetic substance such as ferrite. All or some of the insulating layers 2*a* may be formed of non-magnetic layers instead of magnetic layers. Such non-magnetic layers are formed of a non-magnetic substance such as borosilicate glass and a ceramic filler.

The element body 2 is formed in a substantially rectangular parallelepiped shape. In FIG. 1, the surfaces of the element body 2 include a left end surface, a right end surface that faces the left end surface, an upper surface, a lower surface that faces the upper surface, a front surface, and a rear surface that faces the front surface.

The coil 3 includes a first coil conductor 10, a second coil conductor 20, a third coil conductor 30, a fourth coil conductor 40, and a fifth coil conductor 50. The first to fifth coil conductors 10 to 50 are sequentially stacked in the stacking direction from bottom to top, are electrically connected in series with each other, and form a helical shape. The coil 3 has a substantially quadrangular shape when viewed in the stacking direction. In this embodiment, the coil 3 has a substantially rectangular shape but may instead have a substantially square shape. Although not illustrated in FIG. 1B, the insulating layers 2*a* are arranged in the spaces between the first to fifth coil conductors 10 to 50.

One end of the coil 3 is connected to the first outer electrode 13*a* and the other end of the coil 3 is connected to the second outer electrode 13*b*. More specifically, an end portion of the first coil conductor 10 is electrically connected to the first outer electrode 13*a* via a first extension conductor, which is not illustrated. An end portion of the fifth coil conductor 50 is electrically connected to the second outer electrode 13*b* via a second extension conductor, which is not illustrated.

As illustrated in FIG. 1A, the first outer electrode 13*a* covers the entire left end surface of the element body 2 and part of each of the upper surface, the lower surface, the front surface, and the rear surface of the element body 2. As illustrated in FIG. 1A, the second outer electrode 13*b* covers the entire right end surface of the element body 2 and part of each of the upper surface, the lower surface, the front surface, and the rear surface of the element body 2.

As illustrated in FIG. 2, the first to fifth coil conductors 10 to 50 are stacked on the insulating layers 2*a* of the element body 2. The first to fifth coil conductors 10 to 50 contain a conductive material such as Ag or Cu.

The first coil conductor 10 extends through less than one complete turn, and has a pattern consisting of three corner portions and four side portions when viewed in the stacking direction. That is, the first coil conductor 10 is formed of a first side portion 101, a second side portion 102, a third side portion 103, and a fourth side portion 104 in this order in a direction from the first extension conductor toward the second coil conductor 20.

The second coil conductor 20 has a substantially linearly shaped pattern when viewed in the stacking direction. That is, the second coil conductor 20 consists of a first side portion 201.

The third coil conductor 30 extends through less than one complete turn, and has a pattern consisting of four corner portions and five side portions when viewed in the stacking direction. That is, the third coil conductor 30 consists of a first side portion 301, a second side portion 302, a third side portion 303, a fourth side portion 304, and a fifth side portion 305 in this order in a direction from the second coil conductor 20 toward the fourth coil conductor 40.

The fourth coil conductor 40 extends through less than one complete turn, and has a pattern consisting of three corner portions and four side portions when viewed in the stacking direction. That is, the fourth coil conductor 40 consists of a first side portion 401, a second side portion 402, a third side portion 403, and a fourth side portion 404 in this order in a direction from the third coil conductor 30 toward the fifth coil conductor 50.

The fifth coil conductor 50 has a substantially linearly shaped pattern when viewed in the stacking direction. That is, the fifth coil conductor 50 consists of a first side portion 501.

Next, the steps of stacking the first to fifth coil conductors 10 to 50 will be described.

Figure 3A:
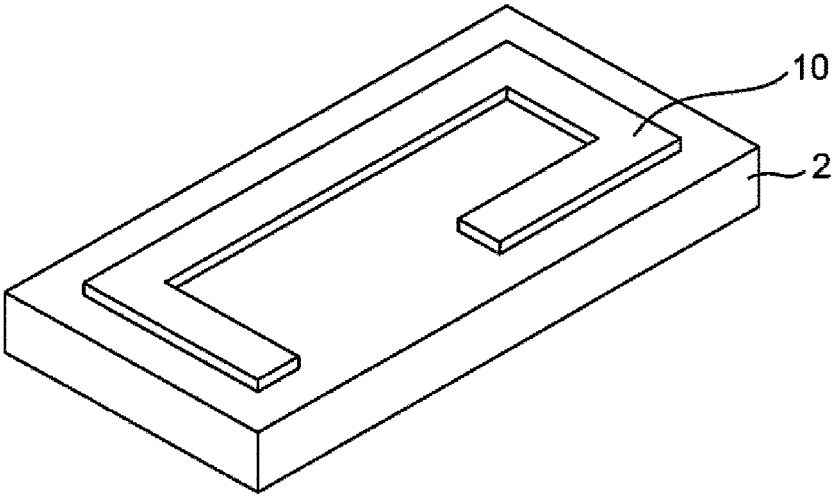
FIG. 3A is an explanatory diagram, seen from a diagonal direction, that is for explaining a step of stacking a coil conductor.

FIGS. 3A to 3E are explanatory diagrams, seen from a diagonal direction, that are for explaining the steps of stacking the coil conductors, and FIGS. 4A to 4E are explanatory diagrams, seen from above, that are for explaining the steps of stacking the coil conductors. FIG. 3A seen from a diagonal direction and FIG. 4A seen from above illustrate the same stacking step, and FIGS. 3B to 3E and FIGS. 4B to 4E have similar relationships with each other.

Figure 3B:
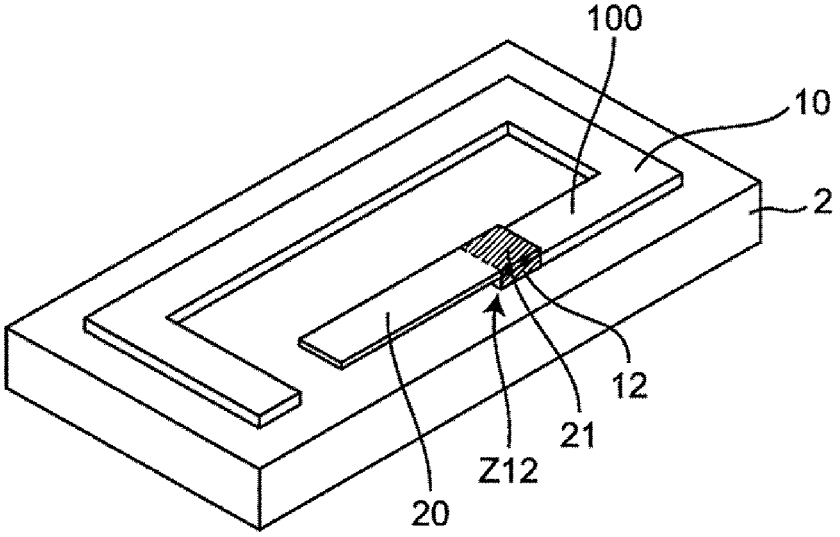
FIG. 3B is an explanatory diagram, seen from a diagonal direction, that is for explaining a step of stacking a coil conductor.
Figure 4A:
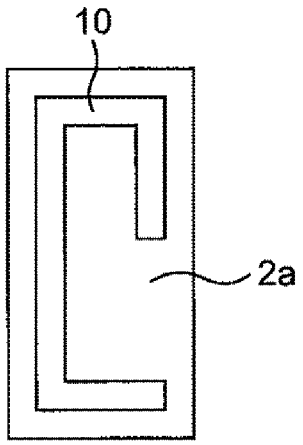
FIG. 4A is an explanatory diagram, seen from above, that is for explaining a step of stacking a coil conductor.
Figure 4B:
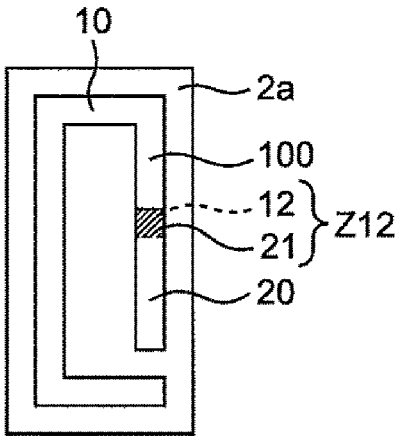
FIG. 4B is an explanatory diagram, seen from above, that is for explaining a step of stacking a coil conductor.

As illustrated in FIG. 3A and FIG. 4A, the first coil conductor 10 is stacked on the insulating layer 2*a*. As illustrated in FIGS. 3B and 4B, the second coil conductor 20 is stacked on the first coil conductor 10 so that one end of the first coil conductor 10 (fourth side portion 104) and one end of the second coil conductor 20 (first side portion 201) overlap and contact each other. That is, the first coil conductor 10 and the second coil conductor 20 contact each other at one side portion.

The first coil conductor 10 has a contact portion 12. The contact portion 12 is the part of the first coil conductor 10 that contacts the second coil conductor 20 that is adjacent thereto in the stacking direction. In addition, the first coil conductor 10 has a non-contact portion 100, which is the part of the first coil conductor 10 that does not contact the second coil conductor 20 that is adjacent thereto in the stacking direction.

The second coil conductor 20 has a contact portion 21. The contact portion 21 is the part of the second coil conductor 20 that contacts the first coil conductor 10 that is adjacent thereto in the stacking direction.

In addition, the pair of contact portions 12 and 21, which are adjacent to each other in the stacking direction and contact each other, form a contact region Z12. The first coil conductor 10 and the second coil conductor 20 are stacked in the stacking direction and are electrically connected to each other via the respective contact portions 12 and 21 thereof.

Figure 3C:
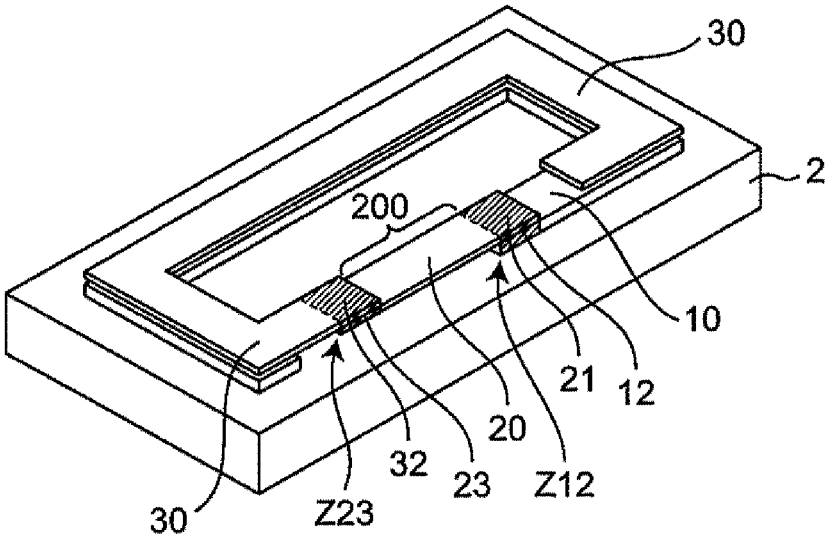
FIG. 3C is an explanatory diagram, seen from a diagonal direction, that is for explaining a step of stacking a coil conductor.
Figure 4C:
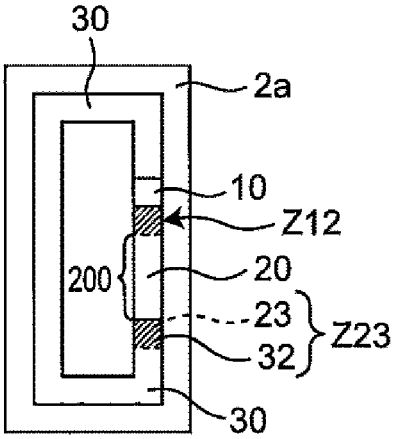
FIG. 4C is an explanatory diagram, seen from above, that is for explaining a step of stacking a coil conductor.

As illustrated in FIGS. 3C and 4C, the third coil conductor 30 is stacked on the second coil conductor 20 so that one end of the second coil conductor 20 (first side portion 201) and one end of the third coil conductor 30 (first side portion 301) overlap and contact each other. That is, the second coil conductor 20 and the third coil conductor 30 contact each other at one side portion.

The second coil conductor 20 has a contact portion 23. The contact portion 23 is the part of the second coil conductor 20 that contacts the third coil conductor 30 that is adjacent to thereto in the stacking direction and the contact portion 23 is located at the opposite end of the second coil conductor 20 from the contact portion 21 that contacts the first coil conductor 10.

In addition, the second coil conductor 20 includes a non-contact portion 200. The non-contact portion 200 is the part of the second coil conductor 20 that does not contact the first coil conductor 10 that is adjacent thereto in the stacking direction and that does not contact the third coil conductor 30 that is adjacent thereto in the stacking direction.

The third coil conductor 30 has a contact portion 32. The contact portion 32 is the part of the third coil conductor 30 that contacts the second coil conductor 20 that is adjacent thereto in the stacking direction.

In addition, the pair of contact portions 23 and 32, which are adjacent to each other in the stacking direction and contact each other, form a contact region Z23. The second coil conductor 20 and the third coil conductor 30 are stacked in the stacking direction and are electrically connected to each other via the respective contact portions 23 and 32 thereof.

Figure 3D:
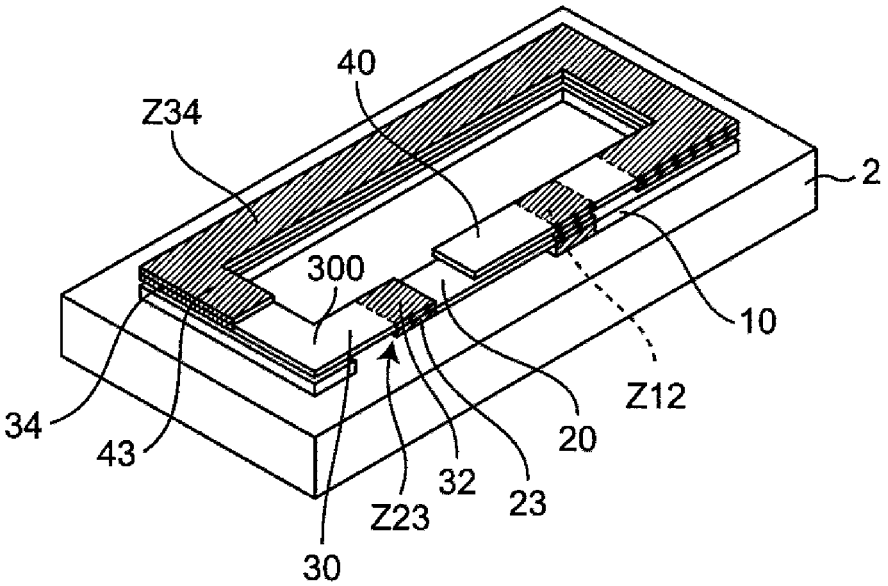
FIG. 3D is an explanatory diagram, seen from a diagonal direction, that is for explaining a step of stacking a coil conductor.
Figure 4D:
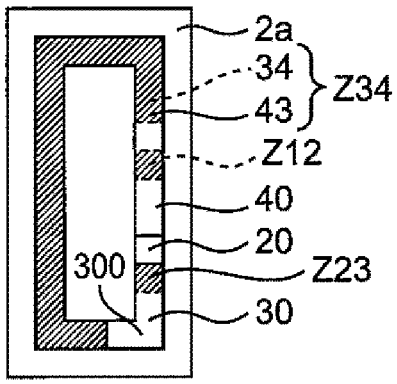
FIG. 4D is an explanatory diagram, seen from above, that is for explaining a step of stacking a coil conductor.

As illustrated in FIGS. 3D and 4D, the fourth coil conductor 40 is stacked on the third coil conductor 30 so that one end of the third coil conductor 30 (from second side portion 302 to fifth side portion 305) and one end of the fourth coil conductor 40 (from first side portion 401 to fourth side portion 404) overlap and contact each other. That is, the third coil conductor 30 and the fourth coil conductor 40 contact each other at four side portions.

The third coil conductor 30 has a contact portion 34. The contact portion 34 is the part of the third coil conductor 30 that contacts the fourth coil conductor 40 that is adjacent thereto in the stacking direction and the contact portion 34 is located at the opposite end of the third coil conductor 30 from the contact portion 32 that contacts the second coil conductor 20.

In addition, the third coil conductor 30 includes a non-contact portion 300. The non-contact portion 300 is the part of the third coil conductor 30 that does not contact the second coil conductor 20 that is adjacent thereto in the stacking direction and that does not contact the fourth coil conductor 40 that is adjacent thereto in the stacking direction.

The fourth coil conductor 40 has a contact portion 43. The contact portion 43 is the part of the fourth coil conductor 40 that contacts the third coil conductor 30 that is adjacent thereto in the stacking direction.

In addition, the pair of contact portions 34 and 43 that are adjacent to each other in the stacking direction and contact each other form a contact region Z34. The third coil conductor 30 and the fourth coil conductor 40 are stacked in the stacking direction and are electrically connected to each other via the respective contact portions 34 and 43 thereof.

Figure 3E:
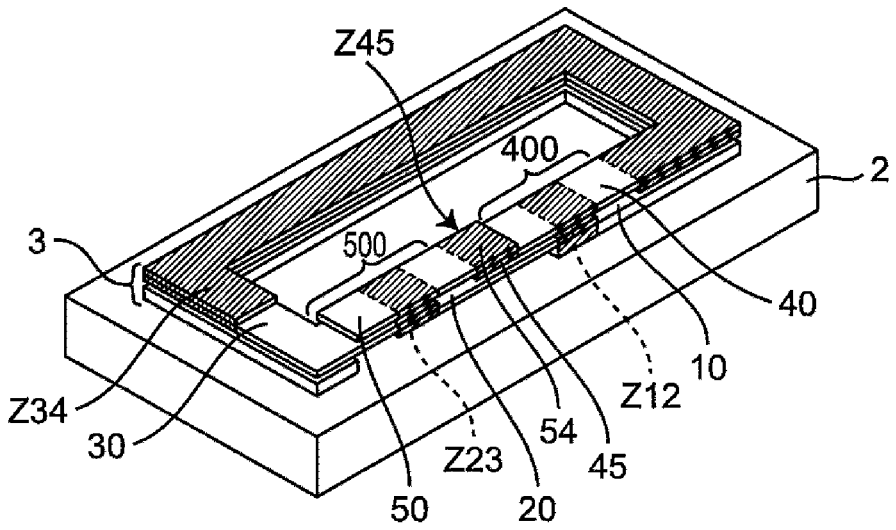
FIG. 3E is an explanatory diagram, seen from a diagonal direction, that is for explaining a step of stacking a coil conductor.
Figure 4E:
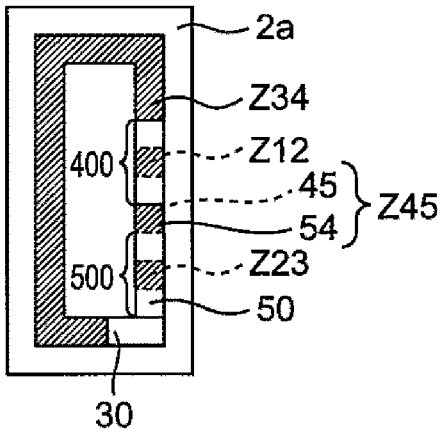
FIG. 4E is an explanatory diagram, seen from above, that is for explaining a step of stacking a coil conductor.

As illustrated in FIGS. 3E and 4E, the fifth coil conductor 50 is stacked on the fourth coil conductor 40 so that one end of the fourth coil conductor 40 (fourth side portion 404) and one end of the fifth coil conductor 50 (first side portion 501) overlap and contact each other. That is, the fourth coil conductor 40 and the fifth coil conductor 50 contact each other at one side portion.

The fourth coil conductor 40 has a contact portion 45. The contact portion 45 is the part of the fourth coil conductor 40 that contacts the fifth coil conductor 50 that is adjacent thereto in the stacking direction and the contact portion 45 is located at the opposite end of the fourth coil conductor 40 from the contact portion 43 that contacts the third coil conductor 30.

In addition, the fourth coil conductor 40 includes a non-contact portion 400. The non-contact portion 400 is the part of the fourth coil conductor 40 that does not contact the third coil conductor 30 that is adjacent thereto in the stacking direction and that does not contact the fifth coil conductor 50 that is adjacent thereto in the stacking direction.

The fifth coil conductor 50 has a contact portion 54. The contact portion 54 is the part of the fifth coil conductor 50 that contacts the fourth coil conductor 40 that is adjacent thereto in the stacking direction.

In addition, the fifth coil conductor 50 has a non-contact portion 500. The non-contact portion 500 is the part of the fifth coil conductor 50 that does not contact the fourth coil conductor 40 that is adjacent thereto in the stacking direction.

In addition, the pair of contact portions 45 and 54, which are adjacent to each other in the stacking direction and contact each other, form a contact region Z45. The fourth coil conductor 40 and the fifth coil conductor 50 are stacked in the stacking direction and are electrically connected to each other via the respective contact portions 45 and 54 thereof.

Thus, the coil 3 is formed by stacking the first to fifth coil conductors 10 to 50 on top of each other, as illustrated in FIG. 1B. As illustrated in FIGS. 1B and 4E, in the coil 3, all of the contact regions Z12, Z23, Z34, and Z45 are located at different positions when the coil 3 is viewed in the stacking direction. The number of turns of the coil 3 is two and number of coil conductor layers included in the coil 3 is five. In FIG. 1B and so forth, the areas corresponding to the contact portions and the contact regions are shaded with hatching.

Figure 5:
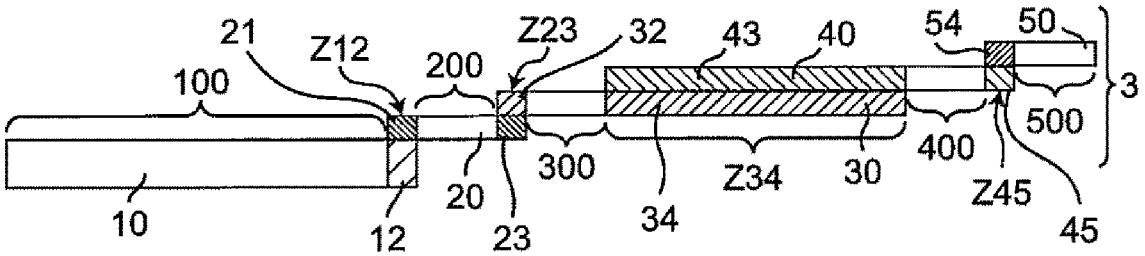
FIG. 5 is a schematic diagram of a coil in which first to fifth coil conductors have been extended out in a straight line.

FIG. 5 is a schematic diagram of the coil 3 in which the coil conductors 10 to 50 have been extended out in a straight line and is for explaining the connection relationships between the first to fifth coil conductors 10 to 50. As illustrated in FIG. 5, the thickness of the first coil conductor 10 is larger than the thicknesses of the third coil conductor 30 and the fourth coil conductor 40.

Therefore, when the lengths of the coil conductors 10 to 50 in the direction in which they extend are referred to as the coil lengths of the coil conductors 10 to 50, the first coil conductor 10, which has a long coil length, contacts the second coil conductor 20, which has a short coil length, and therefore the area of contact between the first coil conductor 10 and the second coil conductor 20 is small, but the direct-current resistance value can be decreased by increasing the cross-sectional area of the first coil conductor 10 by making the thickness of the first coil conductor 10 large.

On the other hand, the third coil conductor 30, which has a long coil length, contacts the fourth coil conductor 40, which has a long coil length, and therefore the area of contact between the third coil conductor 30 and the fourth coil conductor 40 is large and an increase in the direct-current resistance value can be reduced even though the thicknesses of the third coil conductor 30 and the fourth coil conductor 40 are small. Furthermore, the height of the multilayer coil component 1 in the stacking direction can be reduced and a low profile can be achieved for the multilayer coil component 1 by making the thicknesses of the third coil conductor 30 and the fourth coil conductor 40 small.

Therefore, the direct-current resistance value can be made small and a low profile can be achieved in the multilayer coil component 1.

For example, the thickness of the first coil conductor 10 is around 1.2 to 2.8 times and more preferably around 1.5 to 2.5 times the thicknesses of the third coil conductor 30 and the fourth coil conductor 40. The thickness of a coil conductor is the approximate average value of thicknesses along the entire length of the coil conductor.

As illustrated in FIG. 5, the thicknesses of the second coil conductor 20 and the fifth coil conductor 50 are smaller than the thickness of the first coil conductor 10. Thus, although the second coil conductor 20 and the fifth coil conductor 50 are thin, the second coil conductor 20 and the fifth coil conductor 50 have short coil lengths, and therefore an increase in the direct-current resistance value can be reduced. Furthermore, since the second coil conductor 20 and the fifth coil conductor 50 can be made thin, the height of the multilayer coil component 1 in the stacking direction can be reduced and a low profile can be achieved for the multilayer coil component 1. The thicknesses of the second to fifth coil conductors 20 to 50 are the same as each other, but the thickness of at least one coil conductor among these coil conductors may be different from the thicknesses of the other coil conductors.

In the multilayer coil component 1, the third coil conductor 30 and the fourth coil conductor 40 contact each other at at least two side portions (four side portions in this embodiment). As a result, the area of contact between the third coil conductor 30 and the fourth coil conductor 40 is large, and therefore an increase in the direct-current resistance value can be reduced even though the third coil conductor 30 and the fourth coil conductor 40 have small thicknesses.

In the multilayer coil component 1, the first coil conductor 10 and the second coil conductor 20 contact each other at one side portion. Thus, although the area of contact between the first coil conductor 10 and the second coil conductor 20 is small, the direct-current resistance value can be made small by making the thickness of the first coil conductor 10 large.

In the multilayer coil component 1, the first coil conductor 10, the second coil conductor 20, the third coil conductor 30, the fourth coil conductor 40, and the fifth coil conductor 50 are sequentially stacked in the stacking direction, are electrically connected in series with each other, and form two turns. Thus, the number of coil conductor layers that are stacked in two turns of the coil can be made to be five and the number of stacked coil conductor layers can be reduced. Therefore, the height of the multilayer coil component 1 in the stacking direction can be further reduced and a lower profile can be realized for the multilayer coil component 1.

According to the multilayer coil component 1, all of the contact regions (contact regions Z12, Z23, Z34, and Z45) are located at different positions when viewed in the stacking direction, and therefore thick parts of the coil 3 are not concentrated in a single place, and consequently it is possible to avoid the risk of cracking of and the occurrence of a short circuit in the multilayer coil component, for example, cracking of a coil conductor or the element body 2.

With respect to this, if the thick parts of the coil 3 were concentrated in a single place, that is, if a plurality of the contact regions were arranged so as to overlap in the stacking direction, for example, stress would be more likely to be generated due to the difference between the coefficients of linear expansion of the Ag included in coil conductors and the ferrite included in the element body 2, and the risk of the occurrence of cracking, short circuiting and so forth of the multilayer coil component would be high. However, in the case of the multilayer coil component 1 of this embodiment, such risks can be avoided.

Second Embodiment

FIGS. 6A to 6E are explanatory diagrams, which are seen from above, that are for explaining steps of stacking coil conductors in a second embodiment. In addition, FIGS. 7A to 7E are schematic diagrams illustrating the shapes of coil conductors 10*a*, 20*a*, 30*a*, 40*a*, and 50*a* exemplified in the second embodiment.

The second embodiment differs from the first embodiment in terms of the shapes of the first to fifth coil conductors 10*a* to 50*a* of a coil 3*a*. In addition, the second embodiment differs from the first embodiment in that the width of the non-contact portion of at least one coil conductor among the plurality of coil conductors 10*a* to 50*a* is larger than the width of the contact region, as seen in the stacking direction, the coil 3*a* has a quadrangular shape when viewed in the stacking direction, the non-contact portions of the plurality of coil conductors are located on one side of the coil when viewed in the stacking direction, the coil has a rectangular shape when viewed in the stacking direction, and the non-contact portions of the plurality of coil conductors are located on a short side of the coil when viewed in the stacking direction, and so forth.

These differences will be described below. Hereafter, the description will focus on points that are different from the first embodiment. The rest of the configuration is the same as in the first embodiment, and parts that are the same as in the first embodiment are denoted by the same symbols and description thereof is omitted.

Figure 6A:
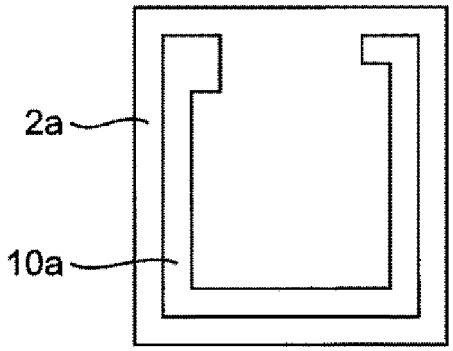
FIG. 6A is an explanatory diagram, seen from above, that is for explaining a step of stacking a coil conductor in a multilayer coil component of a second embodiment.
Figure 7A:
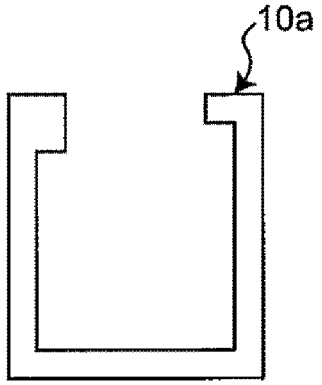
FIG. 7A is a schematic diagram illustrating the shape of a coil conductor exemplified in the multilayer coil component of the second embodiment.

As illustrated in FIG. 6A, the first coil conductor 10*a* is stacked on the insulating layer 2*a*. As illustrated in FIGS. 6A and 7A, the first coil conductor 10*a* extends through less than one complete turn, and has a pattern consisting of four corner portions and five side portions when viewed in the stacking direction. Furthermore, in the first coil conductor 10*a*, the width of one end is larger than the width of the other end when viewed in the stacking direction. "One end" refers to one end of one coil conductor in the length direction of the coil and "the other end" refers to the other end of the coil conductor that is at the opposite end of the coil conductor in the length direction of the coil.

In addition, the "width" of a coil conductor refers to a dimension of the coil conductor in a direction that is perpendicular to the direction in which the coil conductor extends when viewed in the stacking direction.

Figure 6B:
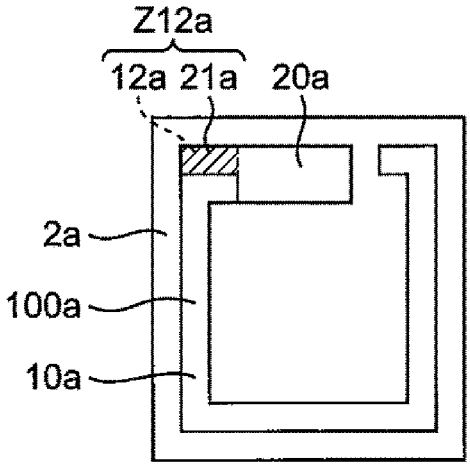
FIG. 6B is an explanatory diagram, seen from above, that is for explaining a step of stacking a coil conductor.

As illustrated in FIG. 6B, the second coil conductor 20*a* is stacked on the first coil conductor 10*a* such that one end (one side portion) of the first coil conductor 10*a* and one end (one side portion) of the second coil conductor 20*a* overlap and contact each other.

The first coil conductor 10*a* has a contact portion 12*a*. The contact portion 12*a* is the part of the first coil conductor 10*a* that contacts the second coil conductor 20*a* that is adjacent thereto in the stacking direction. In addition, the first coil conductor 10*a* has a non-contact portion 100*a* that does not contact the second coil conductor 20*a* that is adjacent thereto in the stacking direction.

Figure 7B:
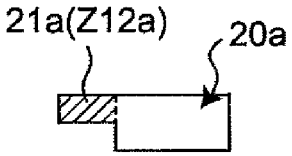
FIG. 7B is a schematic diagram illustrating the shape of a coil conductor.

As illustrated in FIGS. 6B and 7B, the second coil conductor 20*a* has a linearly shaped pattern consisting of one side portion when viewed in the stacking direction. The second coil conductor 20*a* has a shape in which the width of one end thereof is smaller than the width of the other end thereof when viewed in the stacking direction.

The second coil conductor 20*a* has a contact portion 21*a*. The contact portion 21*a* is the part of the second coil conductor 20*a* that contacts the first coil conductor 10*a* that is adjacent thereto in the stacking direction.

In addition, the pair of contact portions 12*a* and 21*a* that are adjacent to each other in the stacking direction and contact each other form a contact region Z12*a*. In other words, the first coil conductor 10*a* and the second coil conductor 20*a* are stacked in the stacking direction and are electrically connected to each other via the respective contact portions 12*a* and 21*a* thereof.

Figure 6C:
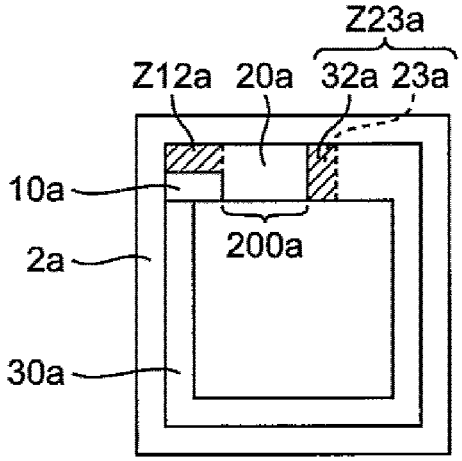
FIG. 6C is an explanatory diagram, seen from above, that is for explaining a step of stacking a coil conductor.

As illustrated in FIG. 6C, the third coil conductor 30*a* is stacked on the second coil conductor 20*a* such that one end (one side portion) of the second coil conductor 20*a* and one end (one side portion) of the third coil conductor 30*a* overlap and contact each other.

The second coil conductor 20*a* has a contact portion 23*a*. The contact portion 23*a* is the part of the second coil conductor 20*a* that contacts the third coil conductor 30*a* that is adjacent thereto in the stacking direction and the contact portion 23*a* is located at the opposite end of the second coil conductor 20*a* from the contact portion 21*a* that contacts the first coil conductor 10*a*.

In addition, the second coil conductor 20*a* includes a non-contact portion 200*a*. The non-contact portion 200*a* is the part of the second coil conductor 20*a* that does not contact the first coil conductor 10*a* that is adjacent thereto in the stacking direction and that does not contact the third coil conductor 30*a* that is adjacent thereto in the stacking direction.

Here, in the second coil conductor 20*a*, the width of the non-contact portion 200*a* is larger than the width of the contact portion 21*a* (that is, the contact region Z12*a*). As a result, the cross-sectional area of the coil conductor in the non-contact portion 200*a* can be increased, and therefore the direct-current resistance value can be reduced.

Figure 7C:
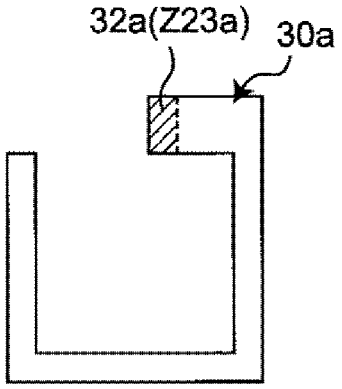
FIG. 7C is a schematic diagram illustrating the shape of a coil conductor.

As illustrated in FIGS. 6C and 7C, the third coil conductor 30*a* extends through less than one complete turn, and has a pattern consisting of three corner portions and four side portions when viewed in the stacking direction. In addition, the third coil conductor 30*a* has a shape in which the width of one end thereof is larger than the width of the other end thereof when viewed in the stacking direction.

The third coil conductor 30*a* has a contact portion 32*a*. The contact portion 32*a* is the part of the third coil conductor 30*a* that contacts the second coil conductor 20*a* that is adjacent thereto in the stacking direction.

In addition, the pair of contact portions 23*a* and 32*a* that are adjacent to each other in the stacking direction and contact each other form a contact region Z23*a*. In other words, the second coil conductor 20*a* and the third coil conductor 30*a* are stacked in the stacking direction and are electrically connected to each other via the respective contact portions 23*a* and 32*a* thereof.

Figure 6D:
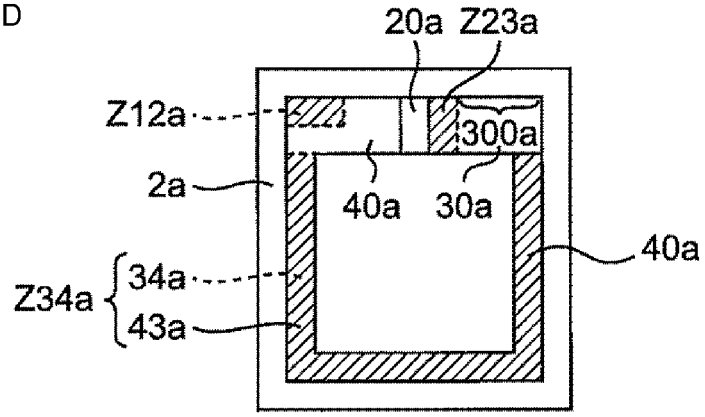
FIG. 6D is an explanatory diagram, seen from above, that is for explaining a step of stacking a coil conductor.

As illustrated in FIG. 6D, the fourth coil conductor 40*a* is stacked on the third coil conductor 30*a* such that one end (three side portions) of the third coil conductor 30*a* and one end (three side portions) of the fourth coil conductor 40*a* overlap and contact each other.

The third coil conductor 30*a* has a contact portion 34*a*. The contact portion 34*a* is the part of the third coil conductor 30*a* that contacts the fourth coil conductor 40*a* that is adjacent thereto in the stacking direction and the contact portion 34*a* is located at the opposite end of the third coil conductor 30*a* from the contact portion 32*a* that contacts the second coil conductor 20*a*.

In addition, the third coil conductor 30*a* includes a non-contact portion 300*a*. The non-contact portion 300*a* is the part of the third coil conductor 30*a* that does not contact the second coil conductor 20*a* that is adjacent thereto in the stacking direction and that does not contact the fourth coil conductor 40*a* that is adjacent thereto in the stacking direction.

Here, in the third coil conductor 30*a*, the width of the non-contact portion 300*a* is larger than the width of the contact portion 34*a* (that is, a contact region Z34*a*). As a result, the cross-sectional area of the coil conductor in the non-contact portion 300*a* can be increased, and therefore the direct-current resistance value can be reduced.

Figure 7D:
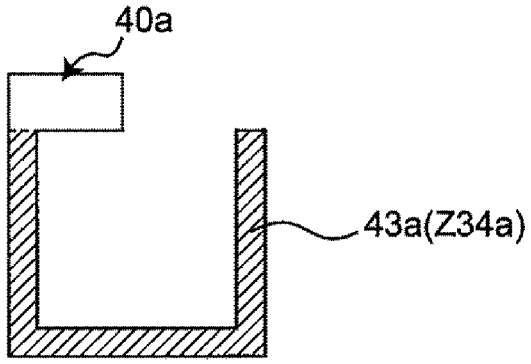
FIG. 7D is a schematic diagram illustrating the shape of a coil conductor.

As illustrated in FIGS. 6D and 7D, the fourth coil conductor 40*a* extends through less than one complete turn, and has a pattern consisting of two corner portions and three side portions when viewed in the stacking direction. In addition, the fourth coil conductor 40*a* has a shape in which the width of one end thereof is larger than the width of the other end thereof when viewed in the stacking direction.

The fourth coil conductor 40*a* has a contact portion 43*a*. The contact portion 43*a* is the part of the fourth coil conductor 40*a* that contacts the third coil conductor 30*a* that is adjacent thereto in the stacking direction.

In addition, the pair of contact portions 34*a* and 43*a* that are adjacent to each other in the stacking direction and contact each other form the contact region Z34*a*. In other words, the third coil conductor 30*a* and the fourth coil conductor 40*a* are stacked in the stacking direction and are electrically connected to each other via the respective contact portions 34*a* and 43*a* thereof.

Figure 6E:
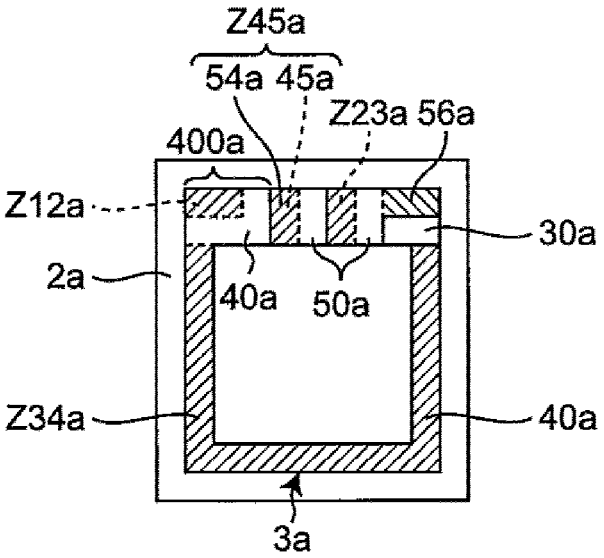
FIG. 6E is an explanatory diagram, seen from above, that is for explaining a step of stacking a coil conductor.

As illustrated in FIG. 6E, the fifth coil conductor 50*a* is stacked on the fourth coil conductor 40*a* such that one end (one side portion) of the fourth coil conductor 40*a* and one end (one side portion) of the fifth coil conductor 50*a* overlap and contact each other.

The fourth coil conductor 40*a* has a contact portion 45*a*. The contact portion 45*a* is the part of the fourth coil conductor 40*a* that contacts the fifth coil conductor 50*a* that is adjacent thereto in the stacking direction and the contact portion 45*a* is located at the opposite end of the fourth coil conductor 40*a* from the contact portion 43*a* that contacts the third coil conductor 30*a*.

In addition, the fourth coil conductor 40*a* includes a non-contact portion 400*a*. The non-contact portion 400*a* is the part of the fourth coil conductor 40*a* that does not contact the third coil conductor 30*a* that is adjacent thereto in the stacking direction and that does not contact the fifth coil conductor 50*a* that is adjacent thereto in the stacking direction.

Here, as illustrated in FIG. 6E, in the fourth coil conductor 40*a*, the width of the non-contact portion 400*a* is larger than the width of the contact portion 43*a* (that is, a contact region Z43*a*). As a result, the cross-sectional area of the coil conductor in the non-contact portion 400*a* can be increased, and therefore the direct-current resistance value can be reduced.

Figure 7E:
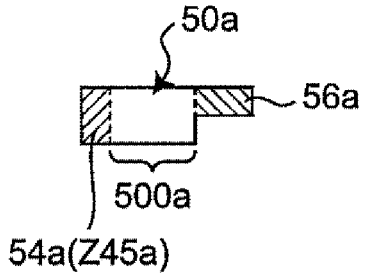
FIG. 7E is a schematic diagram illustrating the shape of a coil conductor.

As illustrated in FIGS. 6E and 7E, the fifth coil conductor 50*a* has a linearly shaped pattern consisting of one side portion when viewed in the stacking direction. In addition, the fifth coil conductor 50*a* has a shape in which the width of one end thereof is larger than the width of the other end thereof when viewed in the stacking direction.

The fifth coil conductor 50*a* has a contact portion 54*a*. The contact portion 54*a* is the part of the fifth coil conductor 50*a* that contacts the fourth coil conductor 40*a* that is adjacent thereto in the stacking direction. In addition, the fifth coil conductor 50*a* has a contact portion 56*a*. The contact portion 56*a* is the part of the fifth coil conductor 50*a* that contacts a sixth coil conductor (not illustrated) that is adjacent thereto in the stacking direction and the contact portion 56*a* is located at the opposite end of the fifth coil conductor 50*a* from the contact portion 54*a* that contacts the fourth coil conductor 40*a*.

The fifth coil conductor 50*a* includes a non-contact portion 500*a*. The non-contact portion 500*a* is the part of the fifth coil conductor 50*a* that does not contact the fourth coil conductor 40*a* that is adjacent thereto in the stacking direction and that does not contact the sixth coil conductor that is adjacent thereto in the stacking direction.

In addition, the pair of contact portions 45*a* and 54*a* that are adjacent to each other in the stacking direction and contact each other form a contact region Z45*a*. In other words, the fourth coil conductor 40*a* and the fifth coil conductor 50*a* are stacked in the stacking direction and are electrically connected to each other via the respective contact portions 45*a* and 54*a* thereof.

Here, in the fifth coil conductor 50*a*, the width of the non-contact portion 500*a* is larger than the width of the contact portion 56*a*. As a result, the cross-sectional area of the coil conductor in the non-contact portion 500*a* can be increased, and therefore the direct-current resistance value can be reduced.

In addition, as illustrated in FIG. 6E, all of the contact regions Z12*a*, Z23*a*, Z34*a*, and Z45*a* and the contact portion 56*a* (in other words, a contact region Z56*a*) are located at different positions when viewed in the stacking direction.

In other words, a plurality of contact regions are not arranged so as to overlap in the stacking direction at the same position when viewed in the stacking direction, and therefore the height of the coil 3*a* in the stacking direction can be reduced. Therefore, the height in the stacking direction can be reduced, and consequently a low profile can be realized for the multilayer coil component.

As illustrated in FIGS. 6A to 6E, the coil 3*a* has a substantially quadrangular shape when viewed in the stacking direction, and for example, has a substantially rectangular shape when viewed in the stacking direction.

As illustrated in FIGS. 6C to 6E, the respective non-contact portions of a plurality of coil conductors, for example, the large-width non-contact portions 200*a*, 300*a*, 400*a*, and 500*a* are located on one side of the coil when the coil is viewed in the stacking direction. Thus, large-width non-contact portions can be arranged so as to be concentrated along one side of the coil, and the inductance (L) can be further improved without reducing the area of the inner-diameter part of the coil.

Thus, in at least one coil conductor among the plurality of coil conductors 10*a* to 50*a*, the width of at least one non-contact portion among the non-contact portions 100*a* to 500*a* when viewed in the stacking direction is larger than the width of the contact portions when viewed in the stacking direction. As a result, the cross-sectional area of the coil conductor in the non-contact portion can be increased, and therefore the direct-current resistance value can be reduced.

For example, in at least one coil conductor among the plurality of coil conductors 10*a* to 50*a*, the width of at least one non-contact portion among the non-contact portions 100*a* to 500*a* when viewed in the stacking direction is around 1.2 to 2.8 times the width of the contact portions 12*a* to 56*a*, and is preferably around 1.5 to 2.5 times the width of the contact portions 12*a* to 56*a*. The ratio between the width of a non-contact portion and the width of a contact portion is the ratio between the coil conductor width in the largest-width part of the non-contact portion and the coil conductor width in the smallest-width part of the contact portion in at least one coil conductor among the plurality of coil conductors 10*a* to 50*a*.

In addition, in at least one coil conductor, the width may be small in at least part of the contact portion and the width may be large in at least part of the non-contact portion.

Furthermore, the coil 3*a* has a substantially rectangular shape when viewed in the stacking direction, and the respective non-contact portions 200*a*, 300*a*, 400*a*, and 500*a* of the plurality of coil conductors may be arranged along a short side of the coil when viewed in the stacking direction. As a result, the inner-diameter part of the coil is substantially square shaped or close to a square shape when viewed in the stacking direction, and therefore the inductance can be further improved.

In addition, in the coil 3*a*, similarly to as in the first embodiment, the thickness of the first coil conductor 10*a* is larger than the thicknesses of the third coil conductor 30*a* and the fourth coil conductor 40*a*. Thus, similarly to as in the first embodiment, the direct-current resistance value can be made small and a low profile can be achieved for the multilayer coil component.

The present disclosure is not limited to the above-described embodiments and design changes can be made within a range that does not depart from the gist of the present disclosure. For example, the characteristic features of the first and second embodiments may be combined with each other in various ways.

For example, the first coil conductor may consist of at least three side portions and the second coil conductor may consist of one or two side portions. In this case, the first coil conductor and the second coil conductor would contact each other at one side portion. In addition, the third coil conductor may consist of at least three side portions and the fourth coil conductor may consist of at least three side portions. In this case, the third coil conductor and the fourth coil conductor would contact each other at at least two side portions. In addition, the fifth coil conductor may consist of one or two side portions.

In the above-described embodiments, two turns are formed using five layers of coil conductors, but this structure may be stacked n times (n is a natural number) to form (2×n) turns using (5×n) layers of coil conductors. Furthermore, the number of coil conductor layers constituting two turns of the coil may be increased or decreased. In addition, the number of turns may be an odd number rather than an even number of turns. Furthermore, the number of turns may be a positive number of turns.

In the above-described embodiments, the first coil conductor, the second coil conductor, the third coil conductor, the fourth coil conductor, and the fifth coil conductor are sequentially stacked in the stacking direction (from bottom to top), but the coil conductors may instead be stacked in opposite order, i.e., the fifth coil conductor, the fourth coil conductor, the third coil conductor, the second coil conductor, and the first coil conductor may be stacked in this order. Alternatively, the coil conductors may be stacked in another different order.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

an element body; and a coil that is provided inside the element body and includes a plurality of coil conductors that are stacked in a stacking direction and are electrically connected to each other;

wherein the coil includes a first coil conductor that includes at least three side portions, a second coil conductor that includes one or two side portions, a third coil conductor that includes at least three side portions, and a fourth coil conductor that includes at least three side portions, the first coil conductor and the second coil conductor contact each other, and the third coil conductor and the fourth coil conductor contact each other, and a thickness of the first coil conductor is larger than a thickness of the third coil conductor and a thickness of the fourth coil conductor.

2. The multilayer coil component according to claim 1, wherein the third coil conductor and the fourth coil conductor contact each other at at least two side portions.

3. The multilayer coil component according to claim 1, wherein the first coil conductor and the second coil conductor contact each other at one side portion.

4. The multilayer coil component according to claim 1, wherein the coil includes a fifth coil conductor that consists of one or two side portions, and the first coil conductor, the second coil conductor, the third coil conductor, the fourth coil conductor, and the fifth coil conductor are sequentially stacked in the stacking direction, are electrically connected in series with each other, and form two turns.

5. The multilayer coil component according to claim 1, wherein each of the coil conductors includes a contact portion that is a part of the coil conductor that contacts another coil conductor adjacent thereto in the stacking direction and a non-contact portion that is a part of the coil conductor that does not contact another coil conductor that is adjacent thereto in the stacking direction, and in at least one coil conductor among the plurality of coil conductors, a width of the non-contact portion is larger than a width of the contact portion.

6. The multilayer coil component according to claim 5, wherein the coil has a substantially quadrangular shape when viewed in the stacking direction, and the respective non-contact portions of the plurality of coil conductors are located at one side of the coil when viewed in the stacking direction.

7. The multilayer coil component according to claim 6, wherein the coil has a substantially rectangular shape when viewed in the stacking direction, and the respective non-contact portions of the plurality of coil conductors are located at a short side of the coil when viewed in the stacking direction.

8. The multilayer coil component according to claim 2, wherein the first coil conductor and the second coil conductor contact each other at one side portion.

9. The multilayer coil component according to claim 2, wherein the coil includes a fifth coil conductor that consists of one or two side portions, and the first coil conductor, the second coil conductor, the third coil conductor, the fourth coil conductor, and the fifth coil conductor are sequentially stacked in the stacking direction, are electrically connected in series with each other, and form two turns.

10. The multilayer coil component according to claim 3, wherein the coil includes a fifth coil conductor that consists of one or two side portions, and the first coil conductor, the second coil conductor, the third coil conductor, the fourth coil conductor, and the fifth coil conductor are sequentially stacked in the stacking direction, are electrically connected in series with each other, and form two turns.

11. The multilayer coil component according to claim 8, wherein the coil includes a fifth coil conductor that consists of one or two side portions, and the first coil conductor, the second coil conductor, the third coil conductor, the fourth coil conductor, and the fifth coil conductor are sequentially stacked in the stacking direction, are electrically connected in series with each other, and form two turns.

12. The multilayer coil component according to claim 2, wherein each of the coil conductors includes a contact portion that is a part of the coil conductor that contacts another coil conductor adjacent thereto in the stacking direction and a non-contact portion that is a part of the coil conductor that does not contact another coil conductor that is adjacent thereto in the stacking direction, and in at least one coil conductor among the plurality of coil conductors, a width of the non-contact portion is larger than a width of the contact portion.

13. The multilayer coil component according to claim 3, wherein each of the coil conductors includes a contact portion that is a part of the coil conductor that contacts another coil conductor adjacent thereto in the stacking direction and a non-contact portion that is a part of the coil conductor that does not contact another coil conductor that is adjacent thereto in the stacking direction, and in at least one coil conductor among the plurality of coil conductors, a width of the non-contact portion is larger than a width of the contact portion.

14. The multilayer coil component according to claim 4, wherein each of the coil conductors includes a contact portion that is a part of the coil conductor that contacts another coil conductor adjacent thereto in the stacking direction and a non-contact portion that is a part of the coil conductor that does not contact another coil conductor that is adjacent thereto in the stacking direction, and in at least one coil conductor among the plurality of coil conductors, a width of the non-contact portion is larger than a width of the contact portion.

15. The multilayer coil component according to claim 12, wherein the coil has a substantially quadrangular shape when viewed in the stacking direction, and the respective non-contact portions of the plurality of coil conductors are located at one side of the coil when viewed in the stacking direction.

16. The multilayer coil component according to claim 13, wherein the coil has a substantially quadrangular shape when viewed in the stacking direction, and the respective non-contact portions of the plurality of coil conductors are located at one side of the coil when viewed in the stacking direction.

17. The multilayer coil component according to claim 14, wherein the coil has a substantially quadrangular shape when viewed in the stacking direction, and the respective non-contact portions of the plurality of coil conductors are located at one side of the coil when viewed in the stacking direction.

18. The multilayer coil component according to claim 15, wherein the coil has a substantially rectangular shape when viewed in the stacking direction, and the respective non-contact portions of the plurality of coil conductors are located at a short side of the coil when viewed in the stacking direction.

19. The multilayer coil component according to claim 16, wherein the coil has a substantially rectangular shape when viewed in the stacking direction, and the respective non-contact portions of the plurality of coil conductors are located at a short side of the coil when viewed in the stacking direction.

20. The multilayer coil component according to claim 17, wherein the coil has a substantially rectangular shape when viewed in the stacking direction, and the respective non-contact portions of the plurality of coil conductors are located at a short side of the coil when viewed in the stacking direction.

* * * * *